US011758958B2

(12) United States Patent
Remmey

(10) Patent No.: US 11,758,958 B2
(45) Date of Patent: Sep. 19, 2023

(54) ELASTIC STRAP FOR APPAREL USE

(71) Applicant: Theresa F. Remmey, Greensboro, NC (US)

(72) Inventor: Theresa F. Remmey, Greensboro, NC (US)

( * ) Notice: Subject to any disclaimer, the term of this patent is extended or adjusted under 35 U.S.C. 154(b) by 186 days.

(21) Appl. No.: 17/353,677

(22) Filed: Jun. 21, 2021

(65) Prior Publication Data

US 2021/0307438 A1 Oct. 7, 2021

Related U.S. Application Data

(63) Continuation of application No. 15/996,905, filed on Jun. 4, 2018, now Pat. No. 11,039,650.

(51) Int. Cl.

| | |
|---|---|
| ***A41B 9/16*** | (2006.01) |
| ***A41F 15/00*** | (2006.01) |
| ***A41D 31/00*** | (2019.01) |
| ***A41F 15/02*** | (2006.01) |

(52) U.S. Cl.

CPC ..... *A41D 31/0005* (2013.01); *A41B 9/16* (2013.01); *A41F 15/00* (2013.01); *A41F 15/002* (2013.01); *A41F 15/02* (2013.01)

(58) Field of Classification Search

CPC .. A41D 31/0005; A41D 2400/44; A41B 9/16; A41F 1/02; A41F 11/02; A41F 11/14; A41F 11/18; A41F 15/00; A41F 15/002; A41F 15/02

USPC ..... 2/195.4, 309, 310, 325, 326, 338, 339; 450/86, 88

See application file for complete search history.

(56) References Cited

U.S. PATENT DOCUMENTS

| | | | | |
|---|---|---|---|---|
| 2,583,992 A * | 1/1952 | Bouteloup | ..... | A41F 9/025 2/237 |
| 2014/0115755 A1* | 5/2014 | Mahar | ..... | A41F 9/025 2/336 |

* cited by examiner

*Primary Examiner* — Sally Haden

(74) *Attorney, Agent, or Firm* — Tuggle Duggins P.A.; Blake P. Hurt

(57) ABSTRACT

A method of combining an auxiliary with a garment includes providing a garment that has an elastic strap attached to it, so that the garment and strap can cooperate to hold the garment in place on a person wearing the garment. The strap has a length with a perforation positioned along the strap length. Tension is applied to stretch the strap to enlarge the perforation, and a solid item that is tethered to an auxiliary is inserted into the stretched perforation. Releasing the tension on the strap so the enlarged perforation resumes an unenlarged size retains the tethered solid item and its tethered auxiliary attached to the strap.

4 Claims, 12 Drawing Sheets

ELASTIC STRAP FOR APPAREL USE

This is a continuation of and claims benefits under pending prior application Ser. No. 15/996,905 filed 4 Jun. 2018, which is a continuation-in-part of and claims benefits under prior application Ser. No. 13/796,102 filed 12 Mar. 2013, each of which are incorporated by reference in their entirety herein.

BACKGROUND OF THE INVENTION

The present invention relates to improvements in wearing apparel, particularly in an improved strap, along with auxiliaries for use with the strap.

Women's apparel often has a strap that extends over the shoulder to hold up a bodice or other fabric that covers her torso, leaving the shoulders substantially exposed. Examples are bathing suits, tank tops, brassieres, slips and other garments.

It is common these days for bra straps to be allowed to be exposed in public, and it is desirable that the bra straps and other garment straps be decorative. However, it is also desirable if the exposed strap could be used in a functional way to provide versatility to a woman's garment selection.

Heretofore straps of these types have simply been relatively solid strips of fabric or other material that passes over the woman's shoulder to support and at least partially suspend the torso-covering-portion of the garment. Often there are strap length adjustments, but virtually no functional attributes for straps are known.

SUMMARY OF THE INVENTION

The present invention fulfills one or more of these needs in the art by providing a garment with a strap including a garment portion to cover a part of a person's body and an elastic strap connected to the garment portion in at least two places, so that the garment portion and strap cooperate to hold the garment in place on a person wearing the garment. The strap has a length with a perforation positioned along the strap length. The elastic strap can be stretched to enlarge the perforation and thereby enable the insertion of a solid item that is tethered to an auxiliary into the enlarged perforation. When the stretch is released, the enlarged perforation resumes an unstretched size to retain the solid item and its tethered auxiliary attached to the strap.

The garment may be a brassiere, a bathing suit, a tank top, a gown, a slip, a corset, etc. The strap of the garment is not a belt or suspenders for a pair of trousers.

There may be a plurality of perforations at positions along the strap length. The strap may be braided of four strands, so the perforations in the strap are located in interstices, between the four strands. In such a four strand braid, the perforations are located with two strands on either side of the perforations.

The strap may include two parallel elastic strands encased in a fabric sheath, and the perforation is located in the fabric sheath, between the elastic strands. The strap may include two parallel elastic strands encased in a fabric sheath with a plurality of perforations located between the elastic strands in the fabric sheath at selected positions along the strap length. The strap preferably includes two parallel elastic strands, each elastic strand encased within separate fabric sheaths, the fabric sheaths connected in a fashion to leave a separating fabric web or joint between the sheaths providing a plurality of spaced apart perforations located between the fabric webs. In other embodiments, there can be more elastic strands, such as three or four. The perforations may be slits having a major axis and are preferably arrayed in the fabric sheath in a line substantially parallel with the major axes of the slits. The auxiliary may be a second garment having the solid item tethered to it. The second garment can be affixed to the first-mentioned garment by inserting a solid item tethered to the second item into the enlarged perforation of the elastic strap of the first garment. When the stretch of the perforation is released, the enlarged perforation resumes an unstretched size to retain the second garment attached to the first garment.

The strap may be solid stretchable plastic and the perforations may include slits in the strap.

The invention can also be considered as a method of combining an auxiliary with a garment includes providing a garment that has an elastic strap attached to it, so that the garment and strap can cooperate to hold the garment in place on a person wearing the garment. The strap has a length with a perforation positioned along the strap length. Tension is applied to stretch the strap to enlarge the perforation, and a solid item that is tethered to an auxiliary is inserted into the stretched perforation. Releasing the tension on the strap so the enlarged perforation resumes an unenlarged size retains the tethered solid item and its tethered auxiliary attached to the strap.

In some embodiments the strap is attached to a first garment and the auxiliary is a second garment, so the method attaches the second garment to the first garment.

Inserting may include selecting one of a plurality of perforations at positions along the strap length for insertion of the solid item.

If the strap is braided of four strands, inserting may include inserting into a perforation in the strap located at an interstice between the four strands. Inserting may include inserting in an interstice located with two strands on either side of the interstice.

If the strap includes parallel elastic strands encased in a fabric sheath, inserting may include inserting in a perforation located in the fabric sheath between the elastic strands.

If the strap is solid stretchable plastic, inserting may include inserting into slits in the strap.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
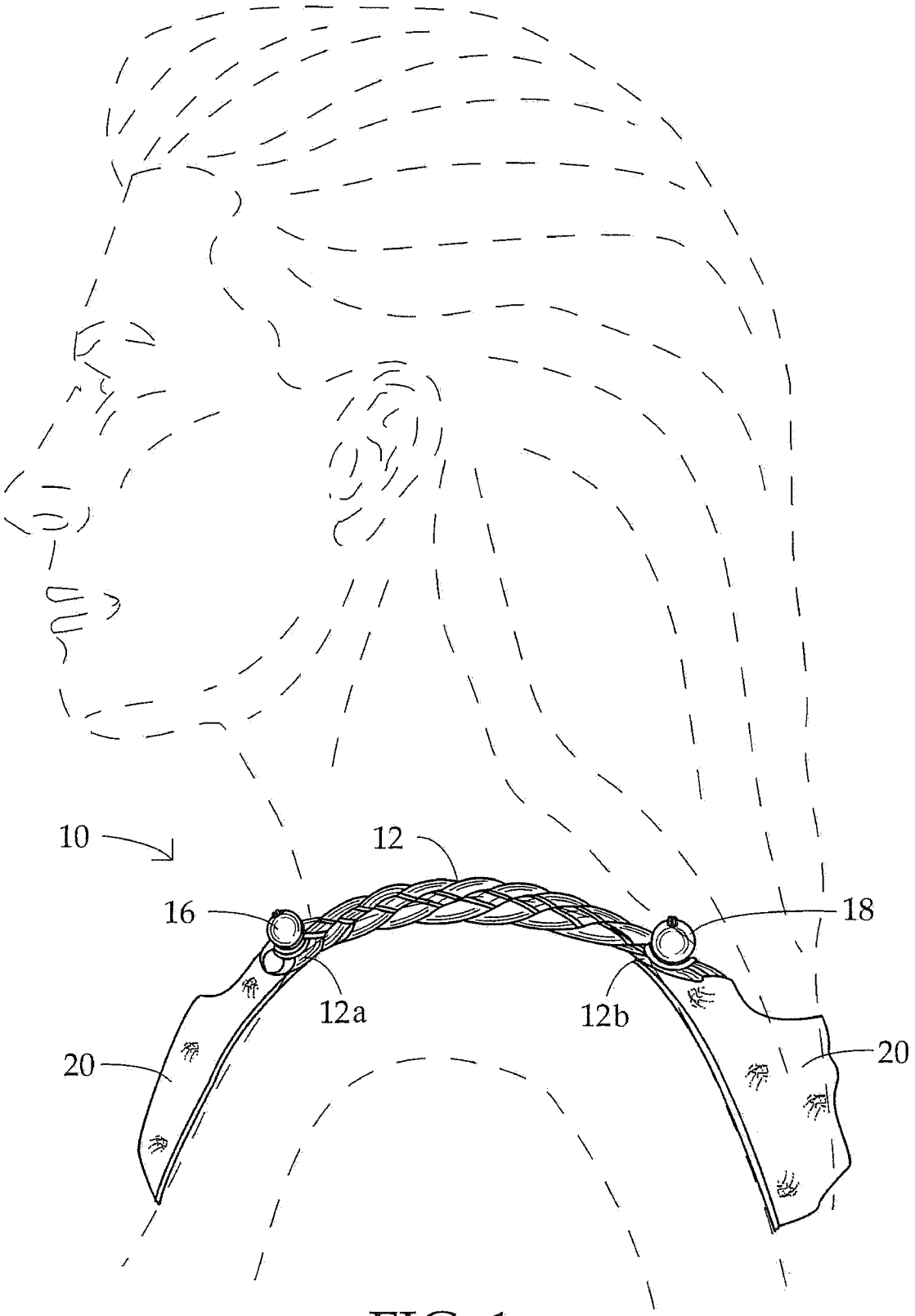
FIG. 1 is a side view of a woman (in phantom) wearing a garment with an exposed strap and attached auxiliary according to an embodiment of the invention.

FIG. 1 shows a woman (in phantom) wearing a garment 10 with an exposed strap 12 having an attached auxiliary 20. The strap is braided with a four-strand braid (the pattern of the braid shows in FIG. 3). The garment auxiliary 20 has beads 16, 18 sewn to it, typically with a relatively long thread attachment, so that the bead can move through the braid while still locally attached to the thread or tether and auxiliary 20. The beads 16, 18 are shown passed through interstices of the strap 12. By so attaching one end 12*a* of the strap 12 to the front of the garment 10 and the other end 12*b* to the rear of the garment 10, the strap 12 passes over the woman's shoulder to hold the garment auxiliary 20 to her body. The garment 10 may be a brassiere, a bathing suit, a tank top, a gown, a slip, a corset, etc. The strap 12 is not a belt for the waist of a pair of trousers or suspenders for trousers.

In an alternative embodiment within the scope of the invention, however, the strap 12 can be sewn to the garment 10 in a relatively permanent fashion. Either way, the interstices of the strap become available for the attachment of various auxiliaries to supplement the garment 10.

Figure 2:
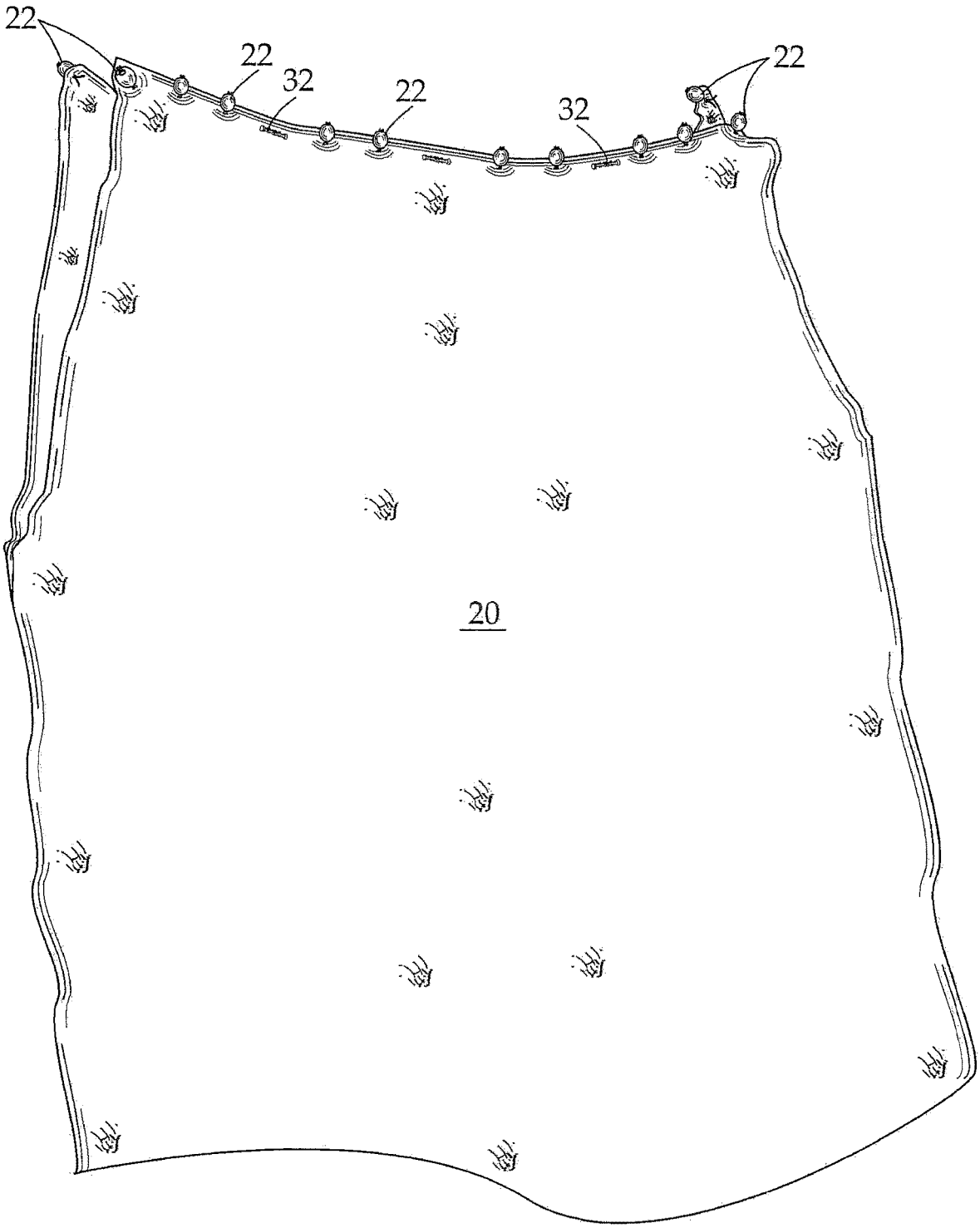
FIG. 2 shows an auxiliary garment shirt, with beads allowing connection to the straps of the first embodiment.

FIG. 2 shows an auxiliary garment such as a T-Shirt 20 having the shoulders and sleeves cut out of it with beads 22 and bars 32, sewn to it at the top. Those beads and bars can be inserted in an opened part of the braid of the strap 12 of FIG. 1, so the shirt 20 can be used as a cover-up, useful when the garment is a bathing suit to which a woman wants to add a cover-up.

The array of beads 22 and bars 32 across the top of the auxiliary garment 20 shown in FIG. 2 allow for selective positioning of the auxiliary garment 20 on the straps 12. That is, not only can the user select which one of the beads or bars to insert to the right or left strap 12 of the garment 10 that is already in place, the wearer can also select where along the strap 12 to insert the bead 22 or bar 32. This provides for variability in the amount of coverage provided by the garment 20, as well as variability in the drape of the garment on the wearer to suit personal preferences.

Figure 8:
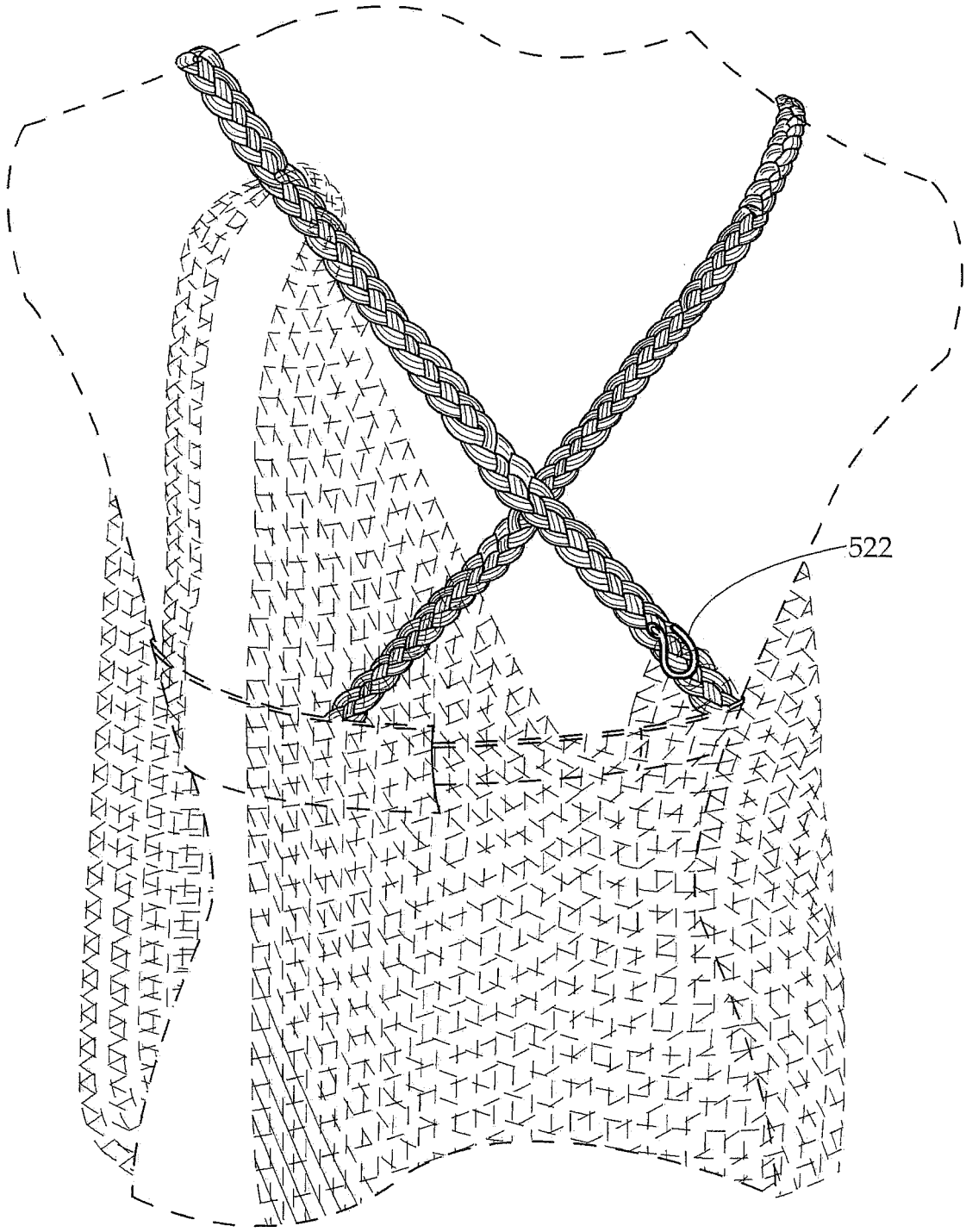
FIG. 8 is the view showing the back of a woman (in phantom) wearing a brassiere having the braided straps and a covering attached to the bra straps.
Figure 9:
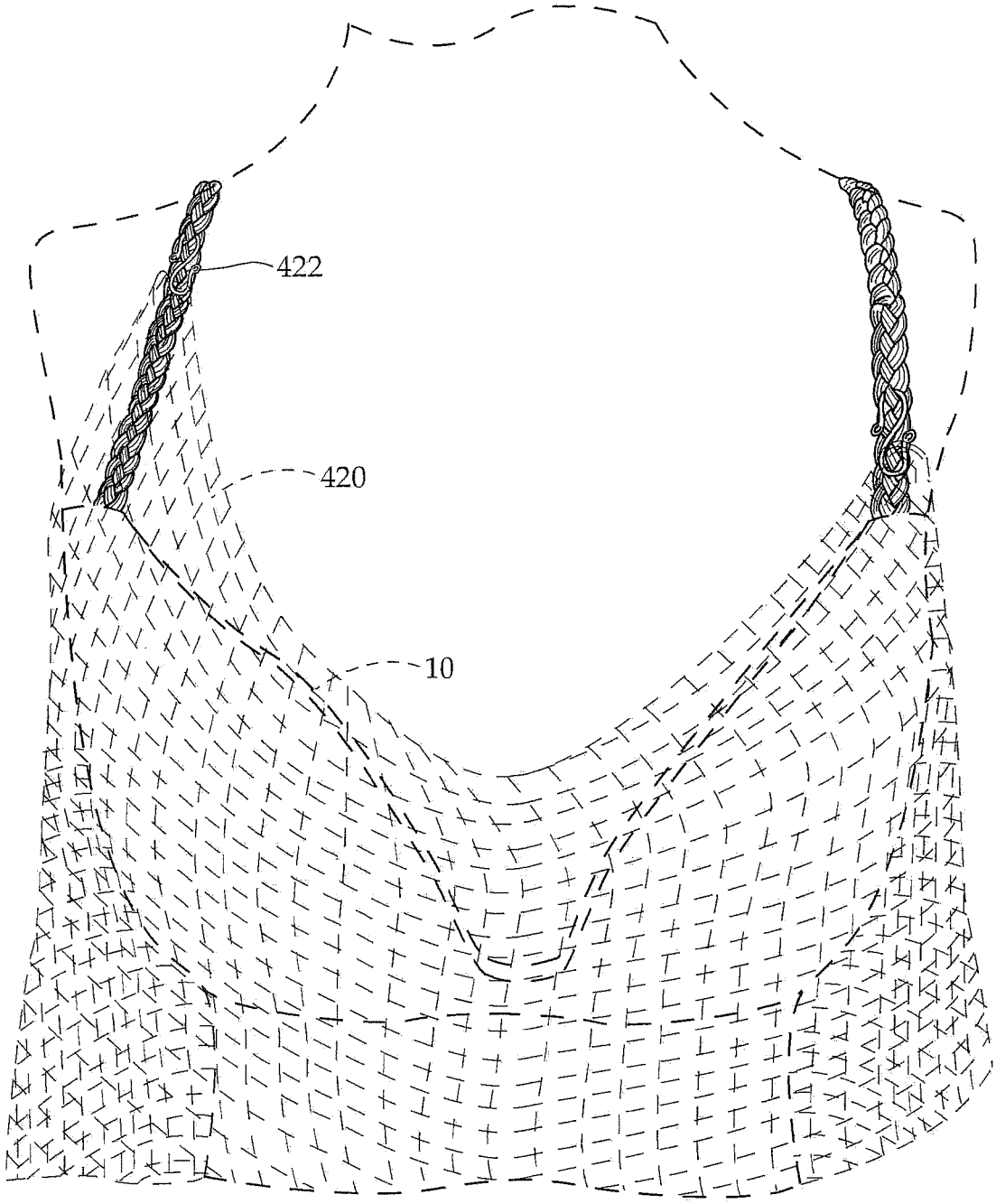
FIG. 9 is a front view of the woman of FIG. 8.

FIGS. 8 and 9 show another way that the strap and auxiliary can cooperate to supplement a basic garment 10. In this case, the garment 10 is a brassiere or a two-piece bathing suit top, with straps in accordance with the invention. The exemplary strap shown in FIGS. 8 and 9 is a three-strand braid, and S-hooks 422 are used to connect the auxiliary 420 to the strap at the wearer's front, providing a fabric cover-up for the basic garment. The S-hooks 422 can be placed at a wide range of possible locations on the strap, to position the auxiliary higher or lower on the strap, controlling the amount of cover-up and the drape of the auxiliary (in the case of the auxiliary having draping characteristics). If changes to the auxiliary's placement are desired, they can be readily accomplished by removing the S-hook from its strap location and relocating as desired. Alternatively, if it is desired to replace the auxiliary with another auxiliary, that can be done in similar fashion. FIG. 8 shows that a sheer or thin auxiliary can be poked through the interstice of the strap (left strap of FIG. 8) such that the auxiliary will go completely through the interstice from one side of the strap to the other side of the strap. Another option is connection with a selectively closable ring 522 (like a key ring) for the right strap of FIG. 8.

Figure 3:
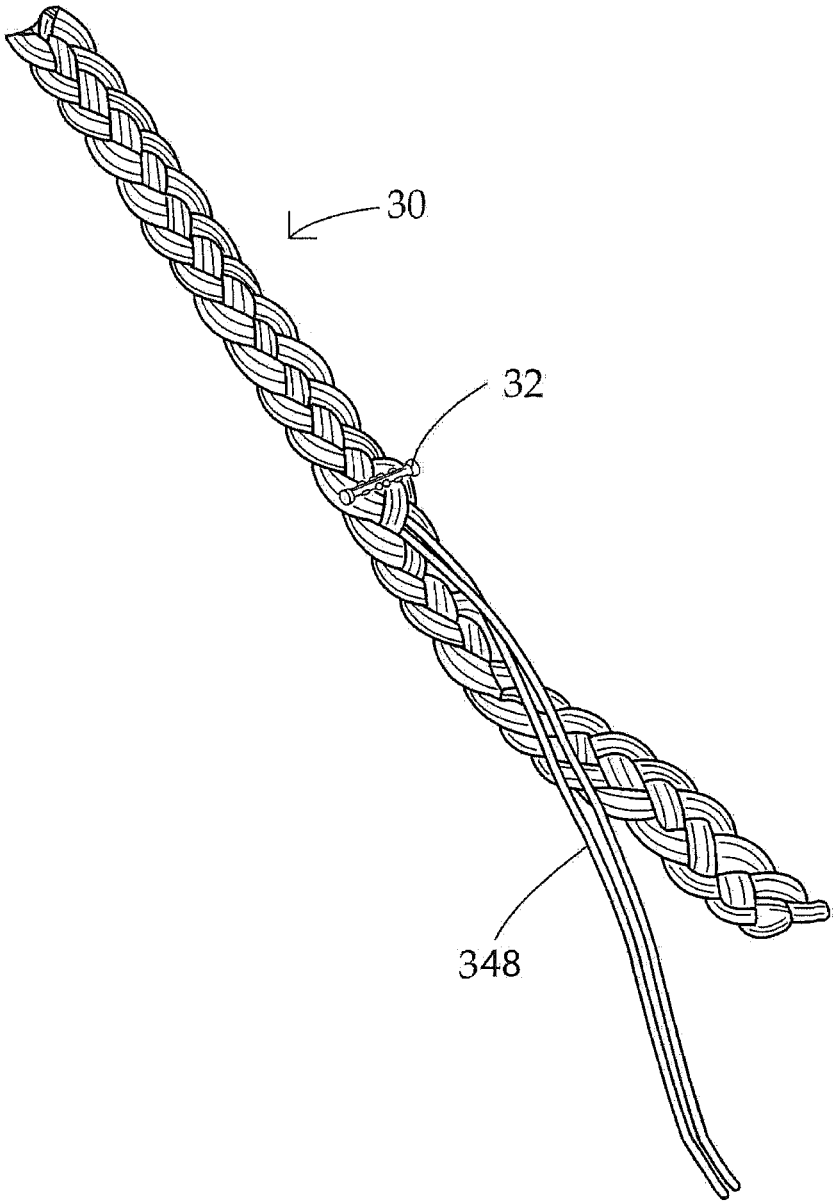
FIG. 3 shows a braided strap, with four strands suitable for use in the invention.

FIG. 3 shows the strap as a braid 30, which can be a conventional braid with four strands. As seen in FIG. 3, the braid 30 has a metal crosspiece 32 inserted in it; the narrow strands 348 extending to the right in FIG. 3 are tethered to the crosspiece 32 behind the strap and so become an auxiliary attached to the braid 30 when the crosspiece 32 is inserted in interstices of the braid. Various additional auxiliaries can be affixed to the strap using the structure of a bead, crosspiece or other solid item tethered to the auxiliary. Auxiliaries can be any of a variety of garments, decorative accessories or other items. Other forms of auxiliaries include scarves and decorative components such as ribbons, jewelry, bows, or perhaps even a corsage. The auxiliary is usually provided with a suitable tethered solid object to insert within the opening in the strap.

Figure 4:
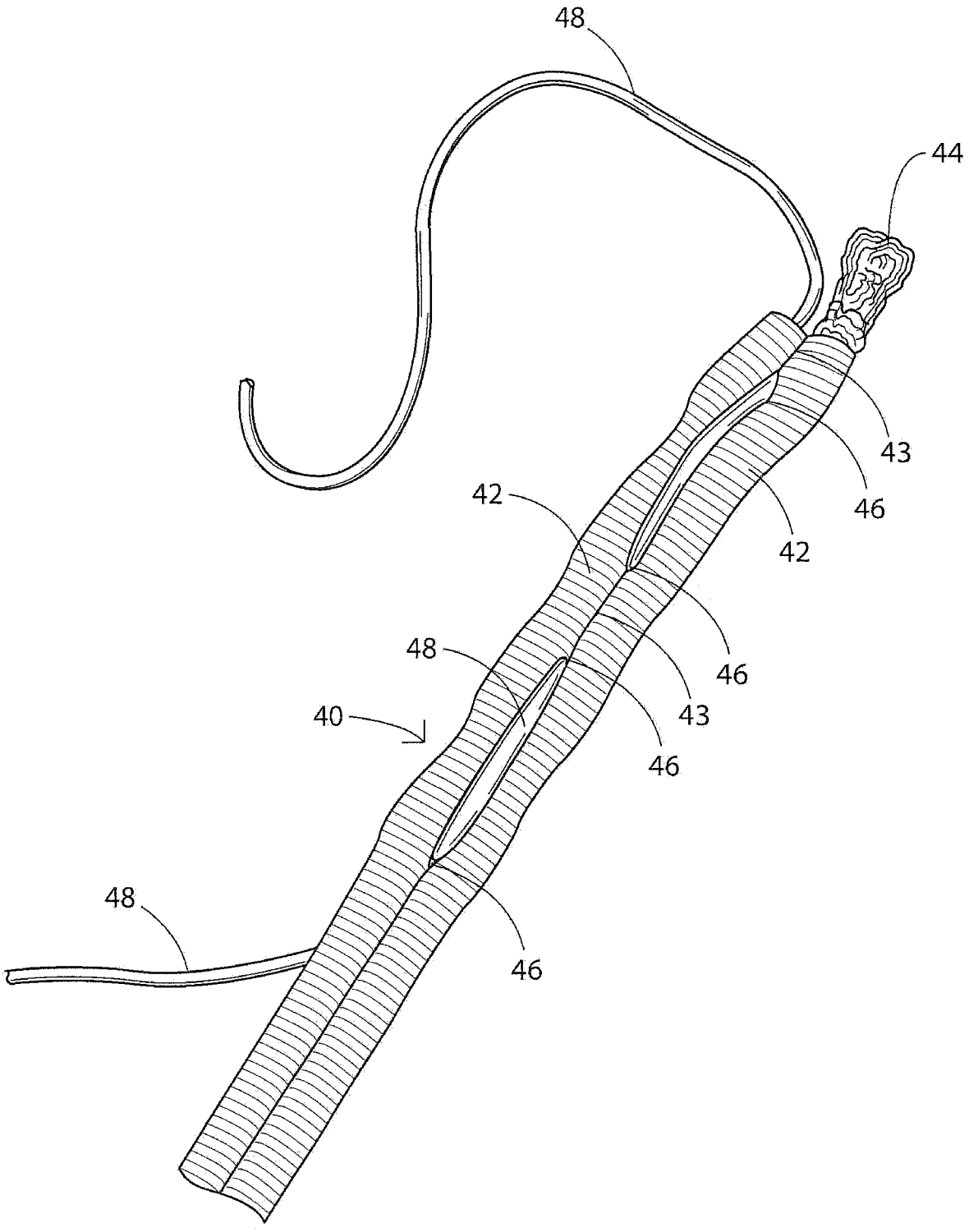
FIG. 4 shows an alternate strap embodiment with an attached supplemental tether.
Figure 7:
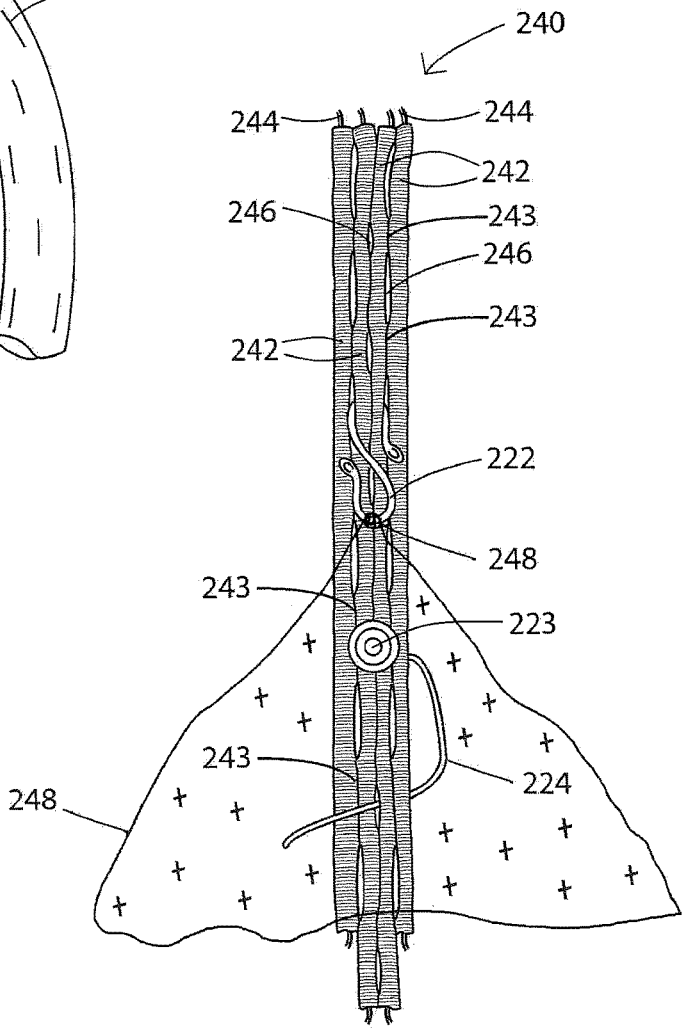
FIG. 7 shows a strap similar to FIG. 4, but instead of only two elastic strands, there are four of them, each elastic strand being encased in its own fabric sheath as seen in FIGS. 4 and 4A.

FIG. 4 shows the alternate embodiment strap 40 in greater detail from a perspective view. In this view of this embodiment, an elastic yarn 44 is seen slightly pulled from the body or sheath 42 of a strap 40. Normally, the elastic yarn 44 is encased in the fabric sheath 42 as demonstrated in the sheath 42 therebeside, however yarn 44 is shown pulled out slightly in FIG. 4 to illustrate the presence of the elastic yarn 44 from within its fabric sheath 42. In the strap 40 shown in FIG. 4, there are two parallel yarns 44 each covered with a fabric sheath 42 in a fashion to leave a separating fabric web 43 between the sheaths 42. Holes 46 are cut or otherwise formed in that fabric web 43 between the two parallel yarns 44 contained within sheaths 42, making openings 46 in which solid items like beads 22 or crosspieces 32 (beads and crosspieces are not shown in this Figure) can be inserted so a tether 48 attached to the bead or crosspiece remains extending through the holes 46 or as seen in FIG. 7 through holes 246. Or as an alternate auxiliary, an additional strand can be passed through the openings, like the strand 48 shown coming up and over fabric webs 43 along the strap, in and out of holes 46. As shown in FIG. 4, strand 48 starts underneath strap 40 and passes upward through a hole 46, goes overtop a fabric web 43 and then passes down through a different hole 46 to continue underneath a different fabric web 43 whereby it then passes upward through another hole 46 and passes overtop another fabric web 43 and then continues downward through yet another hole 46 and is shown extending outward from underneath. As would be understood various other over and under configurations are possible, such as skipping one or two holes to create an aesthetically pleasing attachment.

Figure 4A:
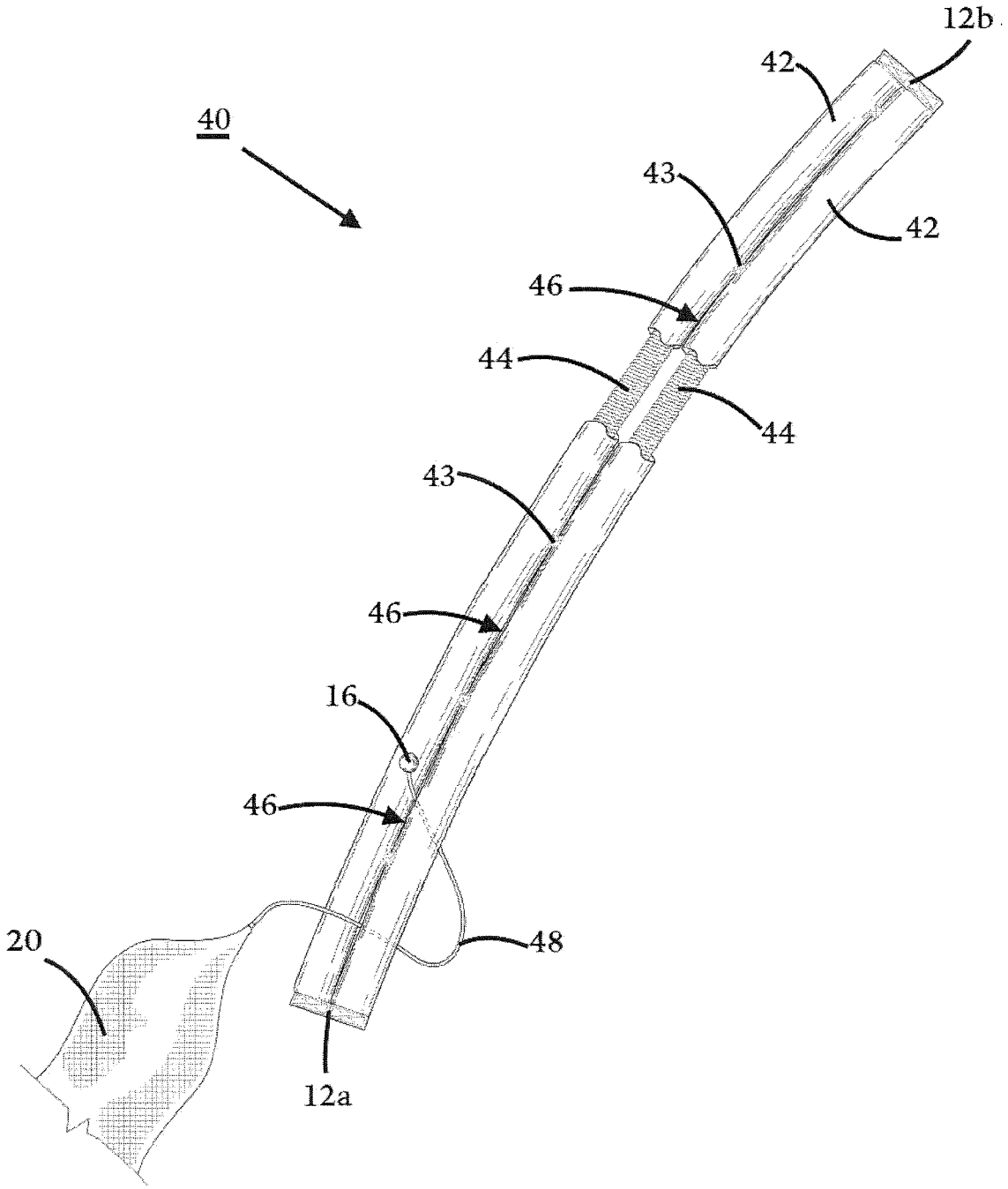
FIG. 4A shows an alternate strap embodiment with an attached supplemental tether.

FIG. 4A presents an additional perspective view of the alternative embodiment strap 40 with certain elements further detailed. In this view, sheaths 42 are partially removed to reveal elastic yarns 44 that are otherwise encased therein. This embodiment of strap 40 illustrates the presence of parallel yarns 44 each encased within separate fabric sheaths 42 in a fashion to leave a separating fabric web or fabric joint 43 between the sheaths 42. Holes, perforations, or other openings 46 are cut or otherwise formed in that fabric web 43 between the two parallel yarns 44 contained within sheaths 42, making openings 46 in which solid items like beads 16 or crosspieces 32 (crosspieces are not shown in this Figure) can be inserted so a tether 48 attached to the bead or crosspiece remains extending through the holes 46 or as seen in FIG. 7 through holes 246. Or as an alternate auxiliary, an additional strand 48 can be passed through the openings 46, like the strand 48 shown coming up and over fabric webs 43 along the strap 40, in and out of holes 46. As shown in FIG. 4A, strand 48 with bead 16 connected thereto starts atop strap 40 and passes downward through a hole 46, goes underneath a fabric web 43 and then passes upwards through a different hole 46 and is shown with bead 16 extending upward therefrom. As would be understood various other over and under configurations are possible, such as skipping one or two holes 46 to create an aesthetically pleasing attachment.

Figure 5:
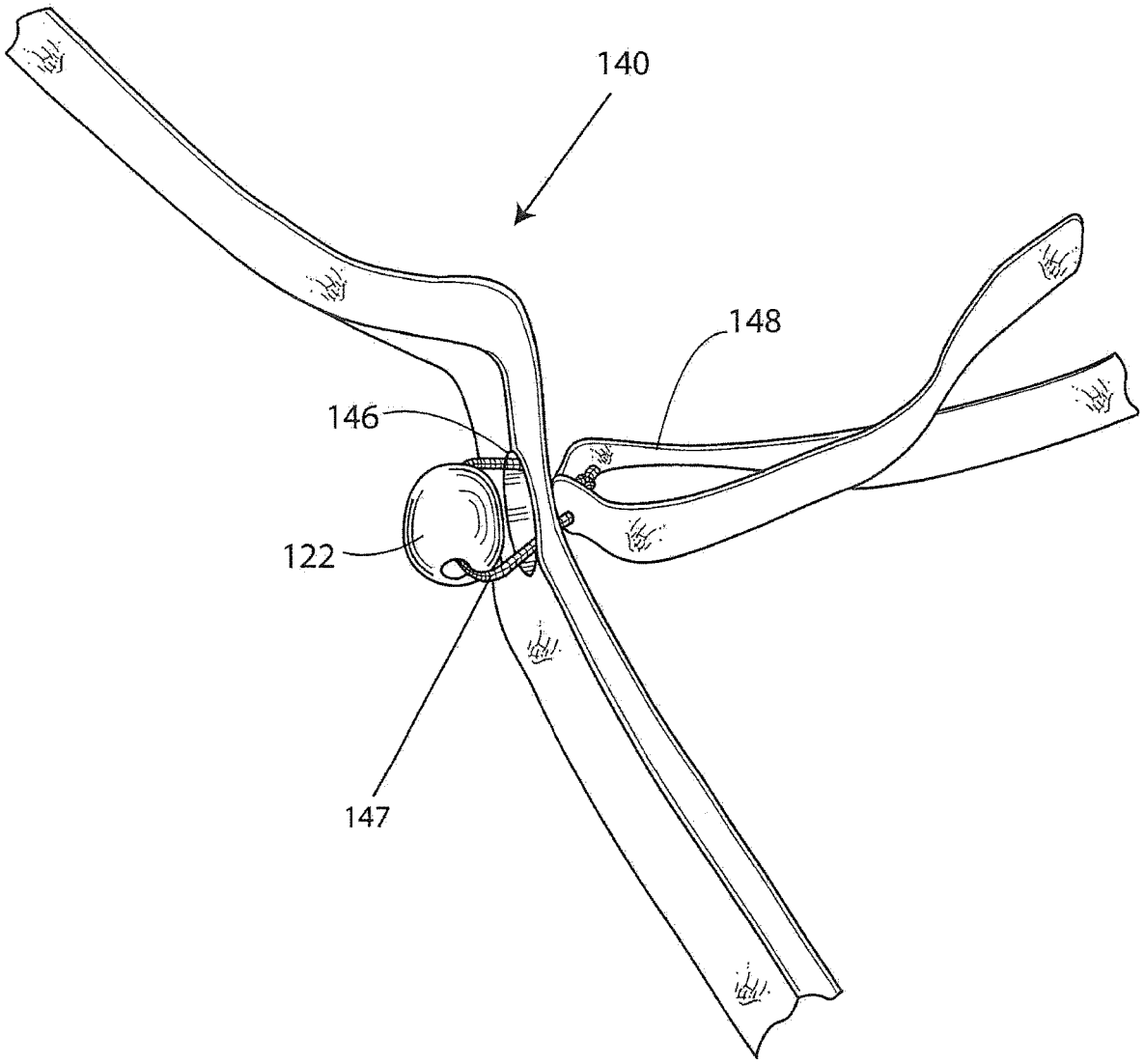
FIG. 5 shows an embodiment similar to FIG. 4 with a varying tethered auxiliary connected with a bead.

FIG. 5 shows a strap 140, again of two elastic yarns each encased in a fabric sheath, and a hole 146 in the web between the elastic yarns. A bead 122 is shown tethered as at 147 to an auxiliary 148. As a result the auxiliary 148 is attached to the strap 140 by the presence of the bead 122 tethered at 147 to the auxiliary 148.

FIG. 7 shows a strap 240 similar to the strap shown in FIG. 4, except it has four elastic yarns 244 each encased in a fabric sheath 242. Holes 246 are formed between the fabric sheaths 242. The result is a plurality of elastic yarns 244 encased in fabric sheaths 242 which are fused or joined at various spaced locations forming fabric webs 243 between adjacent fabric sheaths 242. Also visible in this figure is an exemplary use, including an S-hook 222 that passes through two of the holes 246 and has an attached auxiliary fabric 248. Also visible in the figure is the use of a bead 223 with an attached tether 224 that has moved completely through two of the holes 246 of strap 240.

Figure 6:
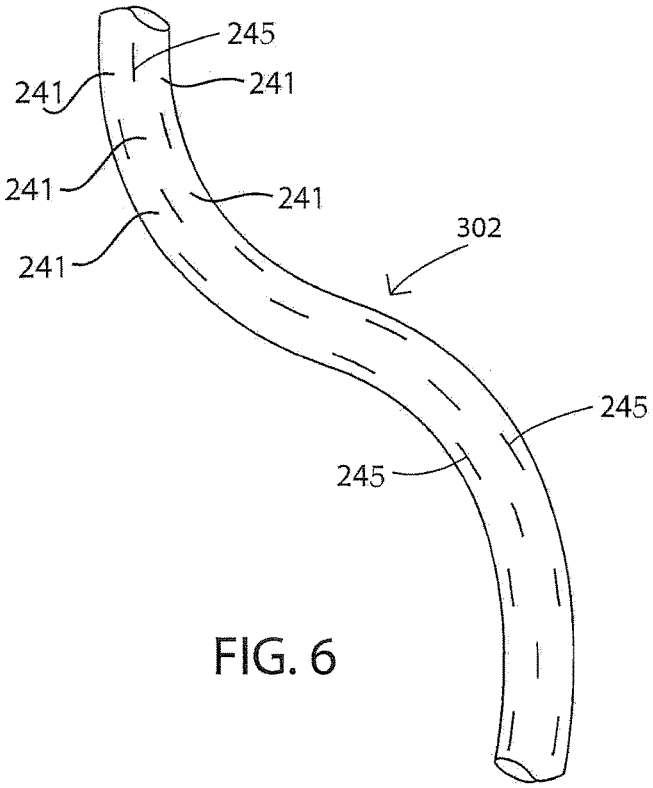
FIG. 6 is a view of another strap embodiment.

FIG. 6 shows another strap of solid stretchable plastic, showing the elastic portion 302. The strap is solid except where the slits 245 are cut completely through the thickness of the solid stretchable plastic without obstruction. Slits 245 in the strap result in stretchable plastic areas 241 there-around on either side of each slit so the slits 245 function just as the interstices and holes described above (referring to FIG. 7), and the strap can be used in the same fashion.

Figure 10:
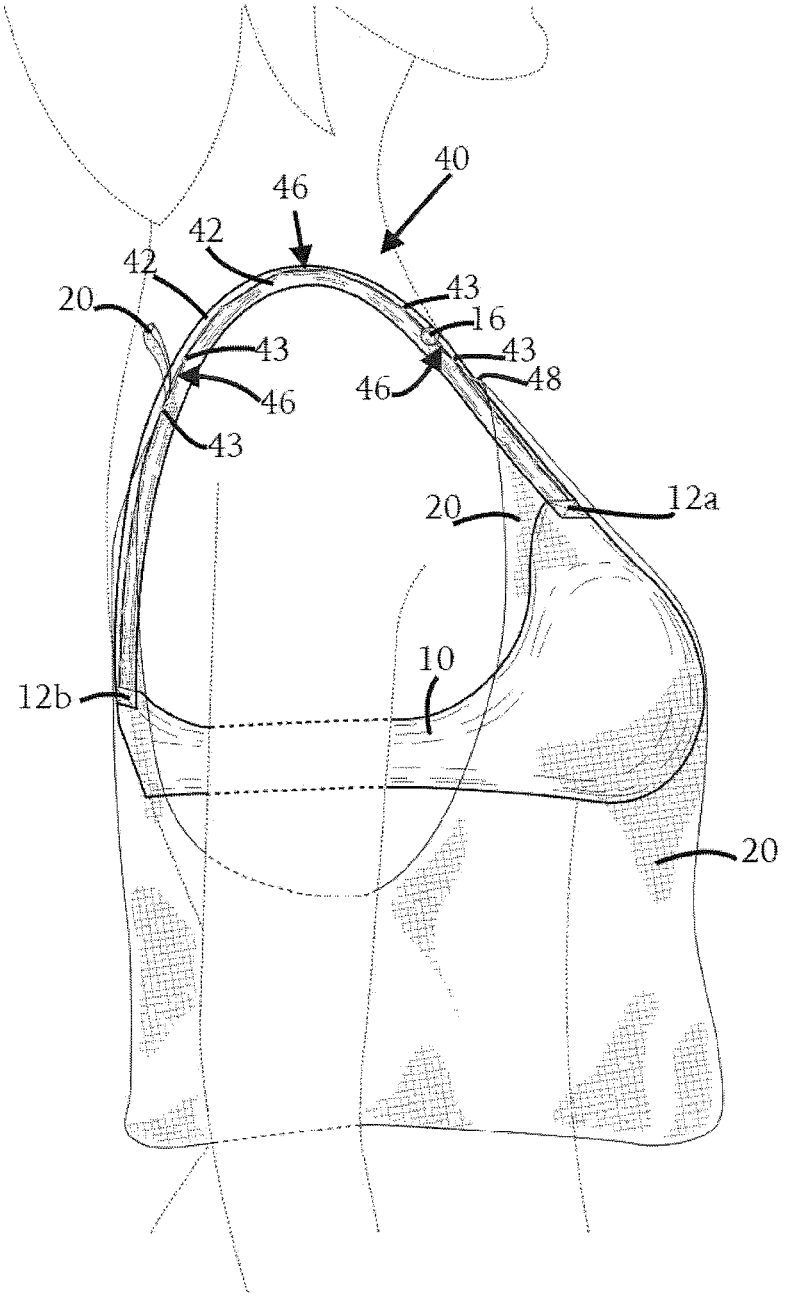
FIG. 10 is a side view of a woman (in phantom) wearing a brassiere having an alternate embodiment strap and the covering attached to the bra straps.

FIG. 10 shows a side view of a women (in phantom) wearing a garment 10 with an alternate embodiment of exposed strap 40 having an attached auxiliary 20. The strap 40, is attached to the garment 10, in the front at the site 12*a* and the other end of the strap 40 is attached to the rear of the garment 10 at the site 12*b*, the strap 40 passes over the woman's shoulder and is adapted to cooperatively hold the garment 10 in place against her torso, all similar to that of strap 12 as seen in FIG. 1. The auxiliary garment 20 attaches to the strap 40 with a tether 48 and bead 16. This tethered bead 16 is shown passed through openings 46 of strap 40 in FIG. 10 and is also demonstrated in FIG. 4A. FIG. 10 shows the strap 40 joined to a brassiere garment 10. Instead of joining with a brassiere the strap 40 can be joined in the same manner with an alternate garment 10 such as a bathing suit, a tank top, a gown, a slip or a corset to function with the strap 40 to hold that garment in place against the woman's torso.

Figure 11:
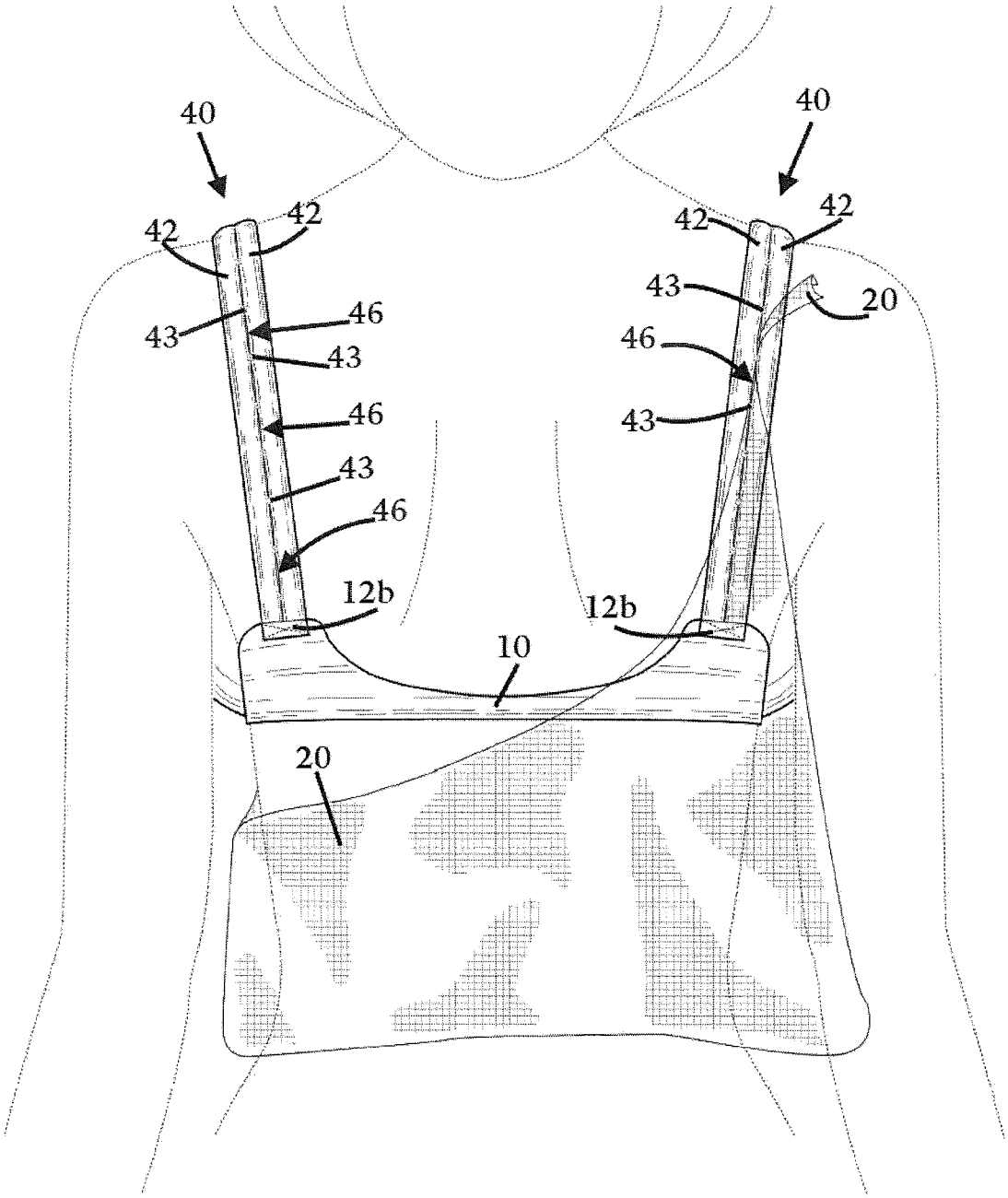
FIG. 11 is a back view of the woman of FIG. 10.

FIG. 11 demonstrates the strap 40 as presented in FIG. 10 viewed from the back of a women (in phantom) wearing a garment 10. As described above, strap 40 is attached to the garment 10 at opposing strap ends at attachment sites 12*a* and 12*b*. Unlike FIG. 4A, FIG. 10 and FIG. 11 show that a sheer or thin auxiliary 20 can be poked completely through the interstice 46, of the strap 40, (back right strap of FIG. 10 and FIG. 11) such that the portion of auxiliary 20 will go completely through the opening 46 from one side of the strap 40 to the other side of the strap 40 and remain in place because of the tension applied from the pinching effect or tension of the elastic strands 44 and associated sheathes 42 on the auxiliary 20 threaded between the two sheathes 42 of the strap 40.

Figure 12:
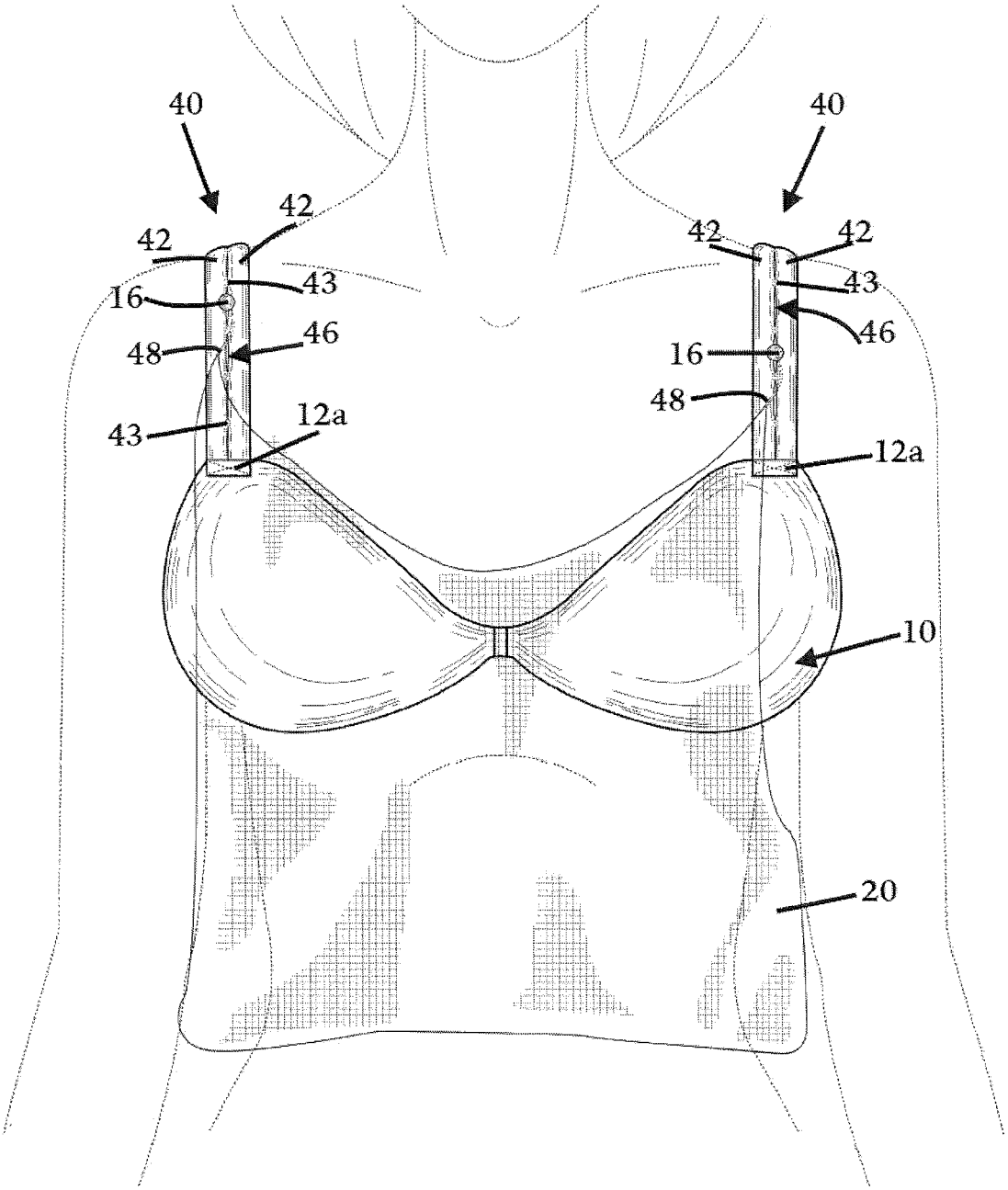
FIG. 12 is a front view of the woman of FIG. 10.

FIG. 12 illustrates the attachment of the auxiliary garment 20 by virtue of passing tether 48 and bead 16 through one or more of the openings 46 defined between sheaths 42 containing elastic strands 44. Also represented on a woman (in phantom) wearing a garment 10, this front view demonstrates a bead 16 and associated tether 48 passing completely through the transverse opening 46 before exiting a different opening 46 defined in respective straps 40 as described above.

Without wishing to be bound to a particular theory, it is believed that the effectiveness of the invention works from the elasticity of the components of the strap, which under tension cause the openings, perforations, slits and interstices to close and pinch down around the tether of the beads or bars or other item which has previously been inserted through that opening. This adds friction to help retain the solid item and its tethered auxiliary in place.

Referring back to FIG. 1, beads 16 and 18 are sewn to the auxiliary 20. Each bead is passed through two aligned interstices of the strap 12 of FIG. 1, so that there are two such friction points on the tether of the bead to the strap 12, providing additional assurance that the bead will not become dislodged from the strap. When it is desired to intentionally cause a separation, the tension on the strap can be released expanding the interstice and allowing withdrawal of the bead or other tethered solid item to allow the auxiliary to be separated from the strap.

Other forms of attachment to perforations in the strap can be used, in addition to the beads and bars shown previously. For example, as seen in FIG. 4, an alternative strand 48 can be inter-engaged by passing through various ones of the perforations, perhaps even knotting upon itself. Also within the scope of the invention are other solid items such as S hooks which are commonly used with conventional bra straps, hooks and eyes, buttons, and the like.

While a braid of an odd number of strands can be used, a four strand braid is preferred for some instances so that by inserting a solid object in a central interstice, the braid remains balanced. If it were inserted through one of the interstices of the three strand braid, the result would be still functionally acceptable, but not as aesthetically pleasing and may in fact be uncomfortable for the wearer.

When the auxiliary is another garment, additional ways to affix the garments together can be added as supplements, such as hook-and-loop connectors, snaps, button and button holes, zippers, etc.

Certain modifications and improvements will occur to those skilled in the art upon reading the foregoing description. It should be understood that all such modifications and improvements have been omitted for the sake of conciseness and readability, but are properly within the scope of the following claims.

The illustrations and examples provided herein are for explanatory purposes and are not intended to limit the scope of the appended claims.

The invention claimed is:

1. A first garment with a strap comprising:

a portion of a first garment and a strap, the portion of the first garment adapted to cover a part of a body, the strap formed from solid stretchable plastic defining opposing terminal ends and a strap length, the solid stretchable plastic strap formed from a plurality of stretchable plastic strap areas, the plurality of stretchable plastic strap areas intermittently connected to one another to define two or more slits therebetween that transversely pass completely through the solid stretchable plastic strap, the two or more slits oriented along the strap length between the plurality of stretchable plastic strap areas and positioned between the strap opposing terminal ends, the two or more slits oriented along the strap length, the portion of the first garment and strap adapted to cooperatively hold the first garment in place on a torso wearing the first garment, a first solid stretchable plastic strap area being connected to a second solid stretchable plastic strap area at a first connection along the strap length, the first solid stretchable plastic strap area being connected to the second solid stretchable plastic strap area at a second connection along the strap length, the first solid stretchable plastic strap area being connected to the second solid stretchable plastic strap area at a third connection along the strap length, the first, second, and third connections being collinear with one another and the strap length, the two or more slits comprising a first slit and a second slit, the first slit between and defined by the first and second connections, the second slit between and defined by the second and third connections, the first and second slits being collinear with one another and the strap length, the strap connected to the portion of the first garment in two places at the opposing terminal ends, wherein the portion of the first garment and the strap are adapted to cooperatively hold the first garment in place on a body wearing the first garment, wherein the first and second slits are sized so that the strap can be relaxed to enlarge one or more of the first and second slits to enable the insertion of a tethered solid item that is tethered to an auxiliary via a tether into one or more of the first and second slits, and when the strap is stretched longitudinally, the first and second slits stretch to close around the tether to retain the tethered solid item and secure the tethered auxiliary attached to the strap;

an auxiliary with a solid item that is tethered to the auxiliary;

wherein the auxiliary is a second garment, the second garment configured to be affixed to the first garment by inserting the solid item tethered to the second garment into one or more of the two or more slits of the strap of the first garment, and when the one or more slits of the two or more slits are relaxed, the one or more slits of the two or more slits resume an unstretched size to retain the second garment attached to the first garment.

2. The first garment with a strap as claimed in claim 1 wherein the strap is not a belt for a waist of a pair of trousers or suspenders for trousers.

3. The first garment with a strap as claimed in claim 1, wherein the plurality of stretchable plastic strap areas comprise a third solid stretchable plastic strap area.

4. The first garment with a strap as claimed in claim 3 wherein the plurality of stretchable plastic strap areas are further defined as two or more parallel solid stretchable plastic strap areas and the two or more slits are located between the plurality of stretchable plastic strap areas which are intermittently connected at positions along the strap length and wherein the two or more slits define a major axis and are arrayed in the solid stretchable plastic strap in a line substantially parallel with the major axis of the strap.

* * * * *